US007617950B2

(12) United States Patent
Norris et al.

(10) Patent No.: US 7,617,950 B2
(45) Date of Patent: Nov. 17, 2009

(54) CONTROLLING FLOW FROM MULTI-CHAMBER CONTAINERS

(75) Inventors: Joseph T. Norris, West Windsor, NJ (US); Scott M. Walsh, Flanders, NJ (US); Christopher Miller, Flemington, NJ (US)

(73) Assignee: Colgate-Palmolive Company, New York, NY (US)

( * ) Notice: Subject to any disclaimer, the term of this patent is extended or adjusted under 35 U.S.C. 154(b) by 327 days.

(21) Appl. No.: 10/852,627

(22) Filed: May 24, 2004

(65) Prior Publication Data

US 2005/0269356 A1 Dec. 8, 2005

(51) Int. Cl.
*B65D 35/24* (2006.01)

(52) U.S. Cl. ..... 222/145.3; 222/1; 222/94; 222/547; 222/564

(58) Field of Classification Search ..... 222/1, 222/94, 145.1, 145.3, 547, 564
See application file for complete search history.

(56) References Cited

U.S. PATENT DOCUMENTS

| | | | | |
|---|---|---|---|---|
| 1,894,115 A | | 1/1933 | Murphy | |
| 2,661,870 A | | 12/1953 | Huenergardt | 222/129 |
| 2,661,871 A | | 12/1953 | Huenergardt | 222/129 |
| 2,939,610 A | | 6/1960 | Castelli et al. | 222/94 |
| 3,197,071 A | | 7/1965 | Kuster | 222/94 |
| 3,467,269 A | | 9/1969 | Newton | 215/6 |
| 3,506,157 A | | 4/1970 | Dukess | 222/94 |
| 4,401,272 A | * | 8/1983 | Merton et al. | 239/337 |
| 4,893,729 A | | 1/1990 | Iggulden et al. | 222/42 |
| 4,964,539 A | | 10/1990 | Mueller | 222/94 |
| 4,974,756 A | | 12/1990 | Pearson et al. | 222/562 |
| 5,114,044 A | | 5/1992 | Spanek | 222/94 |
| 5,228,599 A | * | 7/1993 | Keller | 222/137 |
| 5,765,725 A | | 6/1998 | Matt | 222/129 |
| 5,921,440 A | | 7/1999 | Maines | 222/145 |
| 5,941,420 A | | 8/1999 | Connan | 222/94 |
| 6,161,729 A | | 12/2000 | Gentile et al. | 222/94 |
| 6,223,943 B1 | | 5/2001 | Richmond et al. | |
| 6,283,316 B1 | | 9/2001 | Sherman | 215/6 |

(Continued)

FOREIGN PATENT DOCUMENTS

EP 0 334 648 A 9/1989

(Continued)

*Primary Examiner*—J. Casimer Jacyna
(74) *Attorney, Agent, or Firm*—Amy M. Fernandez

(57) ABSTRACT

The dispensing of substances from multi-chamber containers, such as tubes, can be controlled by the placement of a flow modifying unit in the dispensing nozzle of the container. The dispensing nozzle will have a plurality of channels, usually one for each chamber. The flow controlling unit is a constriction at an intermediate point, a point between the channel inlet and exit, in at least one of the channels. This constriction is sized to adjust flow so that the viscous substance from each chamber is dispensed at a set flow rate and in a set ratio, one to the other. The constriction is formed at the time that the nozzle is formed. In the compression molding process a mold pin is used, the mold pin meeting a mold base at an intermediate point in at least one channel. The mold pin and or mold base has a recess that is the size and shape of the flow modifying constriction. Plastic is injected into the mold and the flow modifying unit is formed at the same time as the nozzle.

21 Claims, 7 Drawing Sheets

U.S. PATENT DOCUMENTS

| | | | | |
|---|---|---|---|---|
| 6,454,130 | B1 | 9/2002 | Miller et al. | 222/94 |
| 6,578,739 | B2 | 6/2003 | Scheifele | 222/94 |
| 6,877,638 | B2 * | 4/2005 | Chan et al. | 222/145.3 |
| 7,232,082 | B2 * | 6/2007 | Muhlhausen et al. | 239/593 |
| 2003/0106903 | A1 | 6/2003 | Chan et al. | 222/94 |
| 2003/0106905 | A1 | 6/2003 | Chan et al. | |

FOREIGN PATENT DOCUMENTS

| | | | |
|---|---|---|---|
| FR | 792 255 | A | 12/1935 |

* cited by examiner

CONTROLLING FLOW FROM MULTI-CHAMBER CONTAINERS

This invention relates to the control of flow of viscous substances from multi-chamber containers. Further this invention relates to a method to form a flow modifying unit in a dispensing nozzle as the nozzle is being formed.

BACKGROUND OF THE INVENTION

Multi-chamber containers are used for a number of products. The primary use is where a product is comprised of two or more incompatible components. These components must be kept separate until the time of use. At that time they can be mixed and used. The incompatibility can be the result of a fast or slow reaction between components. As an example oxidants and reducing agents must be kept separated. Likewise acids and bases must be kept separated. Consumer products where components must be kept separated include hair dye and bleaching products and some dentifrice such as high fluoride formulations, densitizing formulations, baking soda/peroxide formulations and peroxide tooth whitening formulations. A problem that can arise in the dispensing of multi-component formulations from multi-chamber containers and how to get the desired amount to flow from each chamber, This can be equal amounts from each chamber, or differing amounts depending on the product and the components.

A multi-chamber container that is used for some hair coloring products and for some dentifrices is the dual chamber tube. These can be side by side dual chamber tubes as described in U.S. Pat. Nos. 1,894,115; 3,758,520 and 3,980,222 or concentric tubes as described in U.S. Pat. Nos. 1,535,529; 1,639,699 and 1,699,532. The problem of dispensing desired amounts from each chamber of a dual chamber tube has been addressed in U.S. patent applications U.S. 2003/0106903 and U.S. 2003/0106905. The technique in these patent applications is to place a flow controller in the shoulder of the tube. This may can be effective in some instances but is of a complex construction and difficult to adjust for dispensing the substance in varying ratios.

The problem is solved for dual chamber tubes by placing a flow modifying unit in the nozzle of the tube. This facilitates the construction of the flow modifying unit and provides an efficient way to be able to adjust the flow ratio from each chamber. Also by placing the flow modifying unit in the nozzle there can be better control of the suckback of product from the nozzle back down into the tube chamber. Further there is an advantage in that the flow modifying unit can be produced at the time that the nozzle is made through the use of specially designed mold pins.

BRIEF DESCRIPTION OF THE INVENTION

A multi-chamber dispensing tube has a tube body and a dispensing portion. The dispensing portion is comprised of the shoulder and a dispensing nozzle. The dispensing nozzle has a channel connecting the shoulder of each chamber with the exterior of the dispensing tube. The dispensing nozzle and the channels can be of essentially any shape. The dispensing nozzle usually will be circular in cross-section, but can be of any shape. In a two chamber dispensing tube the dispensing nozzle usually will be of a D-shape, the linear part of the D-shape being the nozzle inner divider wall and the curved portion being the nozzle exterior wall. The tube shoulder connects the tube body to the dispensing nozzle.

The flow of product from each chamber of a multi-chamber tube can be affected by putting a flow control unit in one or more of the channels in the nozzle. The flow control unit, preferably is a constriction, and preferably is placed at an intermediate point in the channel, that is, at a point between the channel inlet and the channel exit. It can be placed on an exterior channel wall, an inner divider wall of the channels or on both walls. When on the exterior wall a viscous product being extruded from the tube will tend to have the separate strands come together at the dispensing nozzle exit. When on the interior divider wall the opposite effect of the strands diverging can occur. However, the constriction can be fully or partially on an inner wall, outer wall, or both walls. Usually the flow control unit only will be in one channel since this will efficiently and effectively control the flow of product. However it can be in both channels.

A constriction in a channel also will limit the suckback of a product back down the channel and into the tube shoulder and body. By limiting suckback the product from each chamber is maintained in a "dispensing ready" state, reducing effort to dispense the product and reducing air bubbles in the product.

The flow modifying unit shape, dimensions and placement is determined for each set of products being dispensed. Molding pins used to form the channels of the dispensing nozzle can be machined to create the constriction in the channel as the dispensing portion is simultaneously formed and attached to the tube chamber walls and, divider walls, preferably by compression molding. The mold base also can be machined to produce the constriction. This is accomplished by a recess in the end of one or both of the mold pins for forming a channel and/or in the mold base. It is preferred that the recess to produce the constriction be on the molding pin.

DETAILED DESCRIPTION OF THE INVENTION

The invention will be described in more detail in its preferred embodiments with reference to the drawings. It is understood that the inventive concept is susceptible to additional embodiments, all of which are considered to be encompassed by the present invention.

Figure 1:
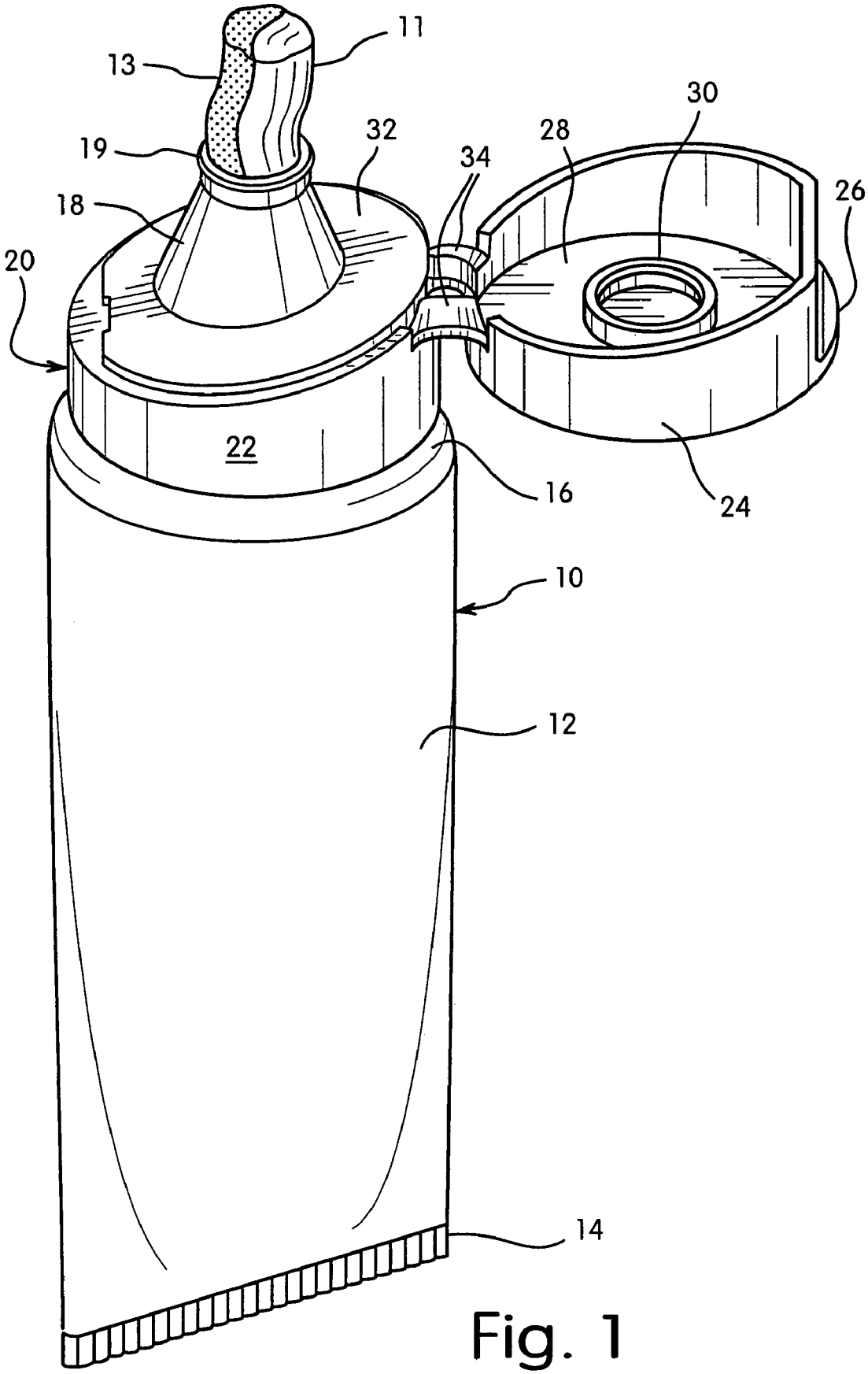
FIG. 1 is a perspective view of a two chamber dispensing tube dispensing a ribbon of product.

FIG. 1 is a perspective view of the multi-chamber container that utilizes a flow control device. This is shown as a dual chamber tube 10. The dual chamber tube is comprised of a tube body 12 with a crimp seal 14 at a lower end and a shoulder 16 at an upper end. The shoulder terminates in nozzle 18 which has an exit opening 19. There is shown in this view a dual component strand 11, 13 exiting the nozzle 18 of the dual chamber tube. Mounted on shoulder 16 is closure 20. This closure is comprised of a base portion 22 and a lid portion 24. The base portion has a deck 32 with a peripheral skirt 22. The nozzle 18 of the tube 10 extends upward through the deck 32. The lid 24 is attached to the deck by hinges 34. The lid is comprised of a lid top wall 28 with a lid skirt 29 depending from the top wall. In the center is seal ring 30 which seals into the nozzle top 19.

Figure 2:
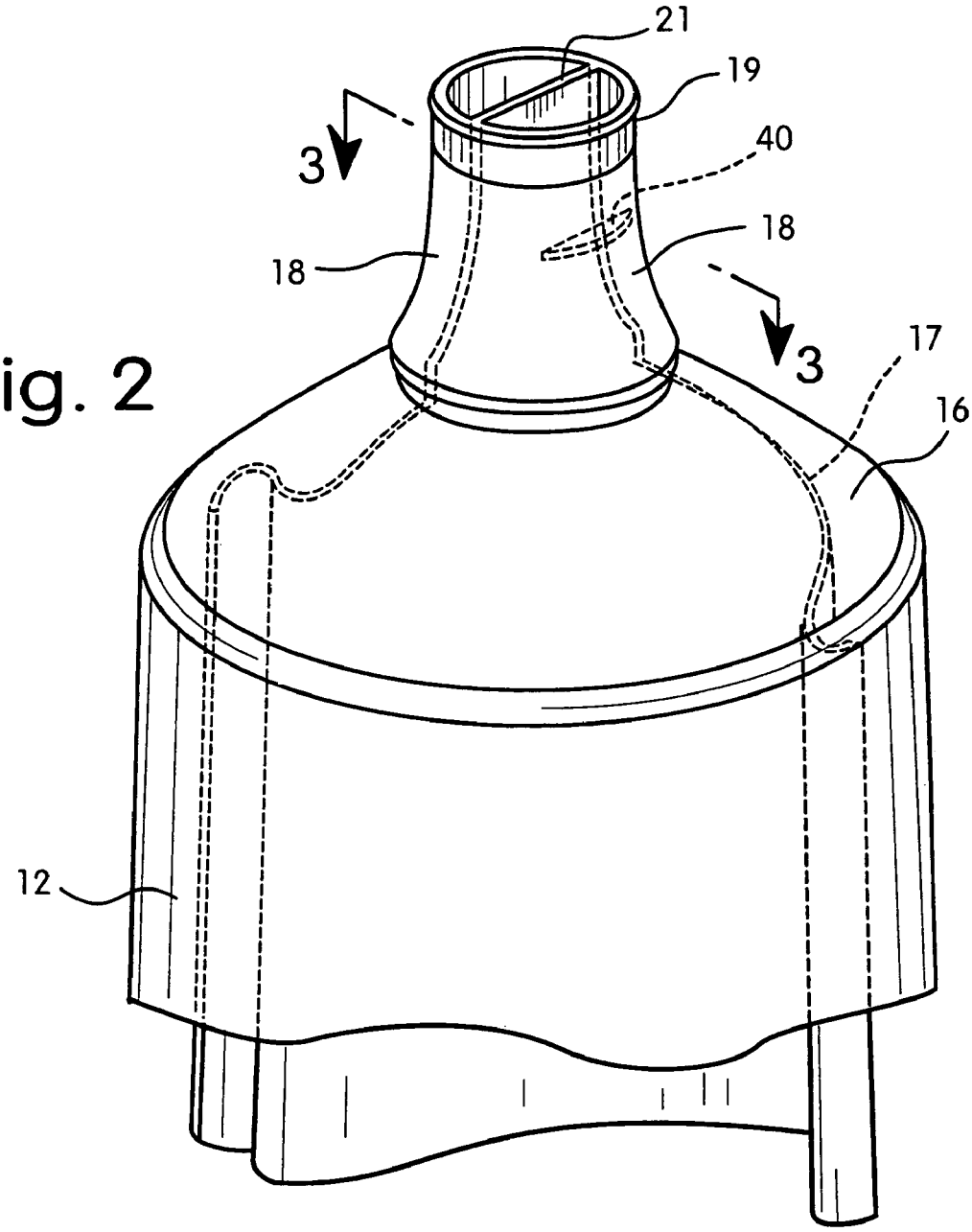
FIG. 2 is a vertical cross-section of the dispensing portion of the tube of FIG. 1 showing a flow modifying constriction on an exterior wall.

FIG. 2 shows the inner structure of the upper part of tube 10. The tube body 12 has an interior divider wall 17. This divider wall extends up through the shoulder 16 and into the end into the nozzle 18. In the nozzle 18 the divider wall 21 will have a greater thickness than in the tube body 12. In the tube body 12 the divider wall 17 can have a thickness of about 0.5 mm to about 1.5 mm. In the nozzle the divider wall 21 will have a thickness of about 0.7 mm to about 2 mm. One useful technique of attaching the divider wall to the shoulder is by compression molding. In this technique the divider wall 21, the shoulder 16, nozzle 18 and the attachment of divider wall 17 of the tube body 12 is accomplished in a single operation. This assures good seals between the different parts and enhances manufacturing speeds.

FIG. 2 also shows the flow controlling projection 40 in nozzle 18. This flow controlling projection 40 will extend to decrease the cross-sectional area of channel 25 by up to about 60 percent or more, and preferably 10 to 50 percent. Although there can be a flow controlling projection in both channels 23 and 25, in almost all instances it will be in a single channel which will be sufficient to balance flow. This will be sufficient to regulate the flow from the tube. Here in FIG. 3 the constriction 40 is a chordal segment. FIG. 3A through 3G show variations n the shape and location of the flow controlling constriction. In FIG. 3A it is connected to divider wall 21. In FIG. 3B the constriction 42 is connected to the nozzle 18 inner wall surface. In FIG. 3C the constrictions 43(*a*), 43(*b*) are at the inner wall surface of nozzle 18. In FIG. 3D the constriction 44 divides nozzle chamber 25 into chambers 25(*a*) and 25(*b*). In FIG. 3E in a variation of FIG. 3B the constriction 46 is crescent shaped and connected to the inner wall surface of nozzle 18. FIG. 3F is a further variation of FIG. 3B where the constriction 47 has a wave-like shape. And FIG. 3G is a variation of FIG. 3C where the constrictions 48(*a*) and 48(*b*) are of a different shape from that of FIG. 3C, but at the intersection of divider wall 21 and the inner wall surface of nozzle 18.

Figure 3:
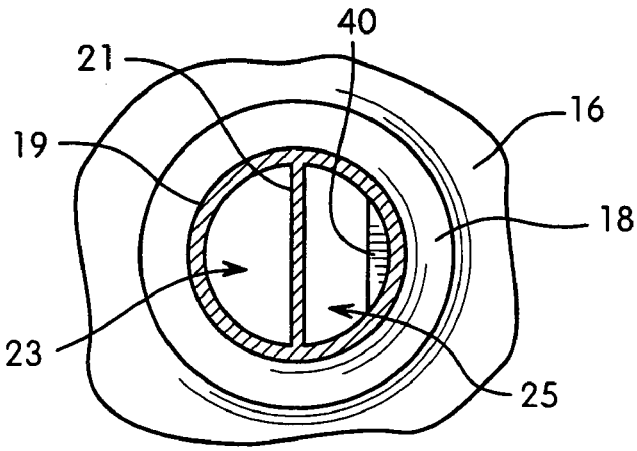
FIG. 3 is a top plan view of the tube of FIG. 2.
Figure 3A:
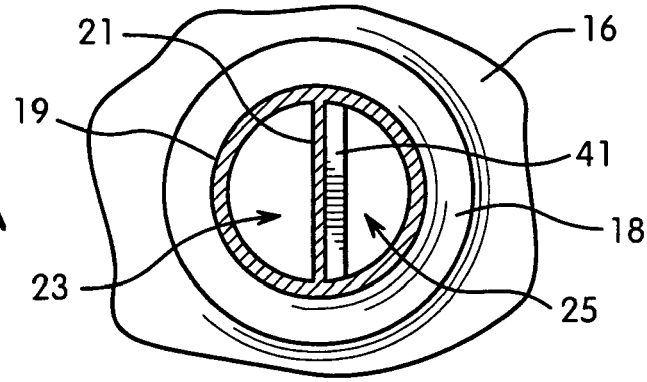
FIG. 3A is an alternate embodiment of the top plan view of FIG. 3.
Figure 3B:
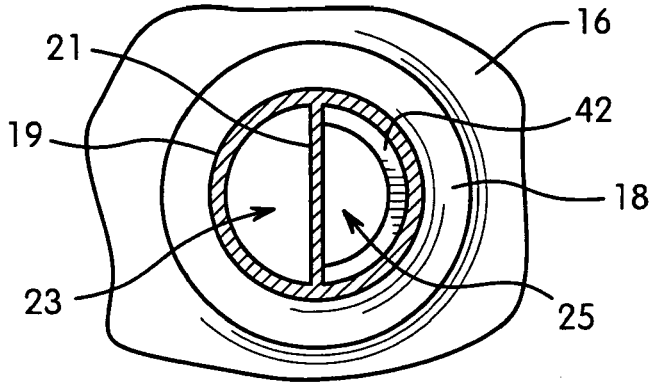
FIG. 3B is an alternate embodiment of the top plan view of FIG. 3.
Figure 3C:
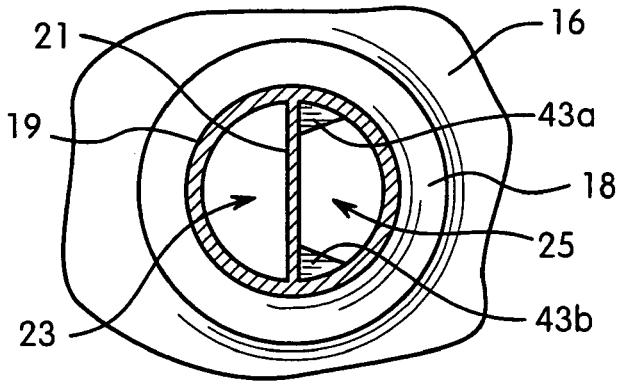
FIG. 3C is an alternate embodiment of the top plan view of FIG. 3.
Figure 3D:
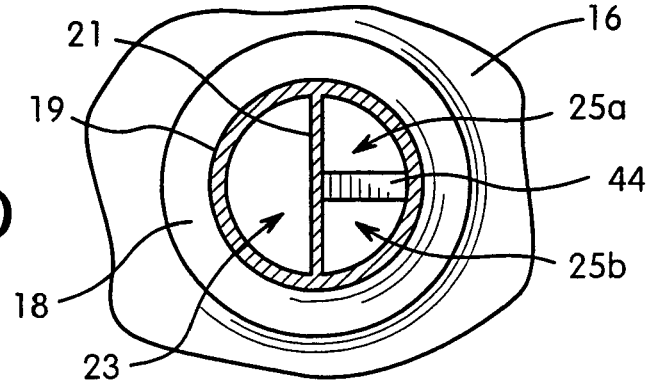
FIG. 3D is an alternate embodiment of the top plan view of FIG. 3.
Figure 3E:
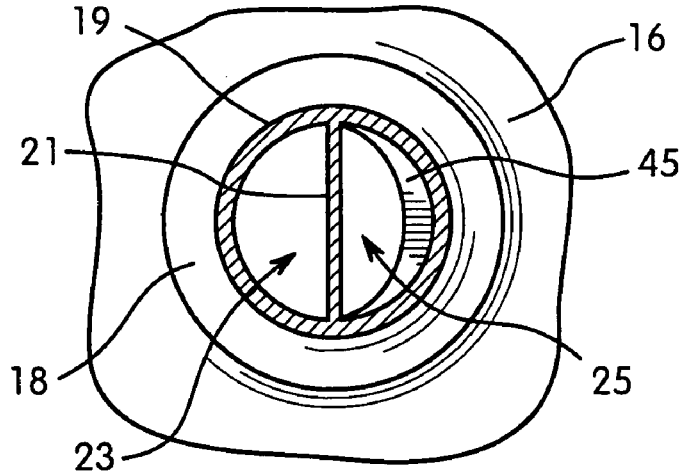
FIG. 3E is an alternate embodiment of the top plan view of FIG. 3.
Figure 3F:
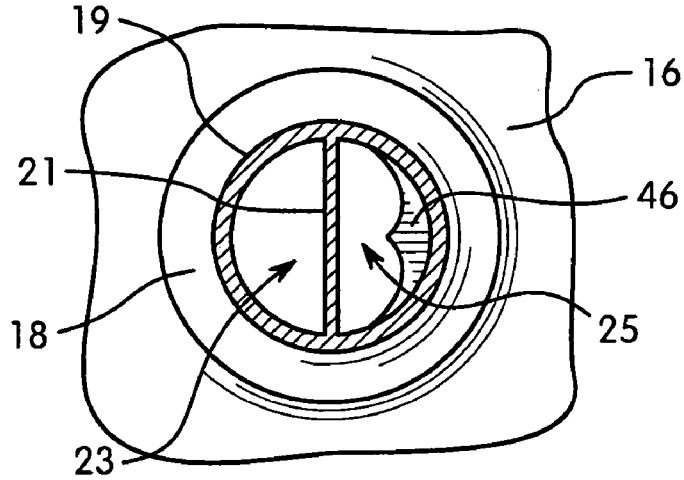
FIG. 3F is an alternate embodiment of the top plan view of FIG. 3.
Figure 3G:
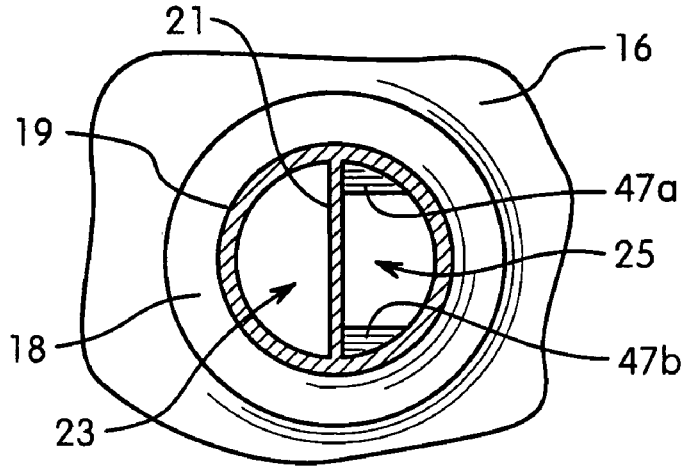
FIG. 3G is an alternate embodiment of the top plan view of FIG. 3.
Figure 4:
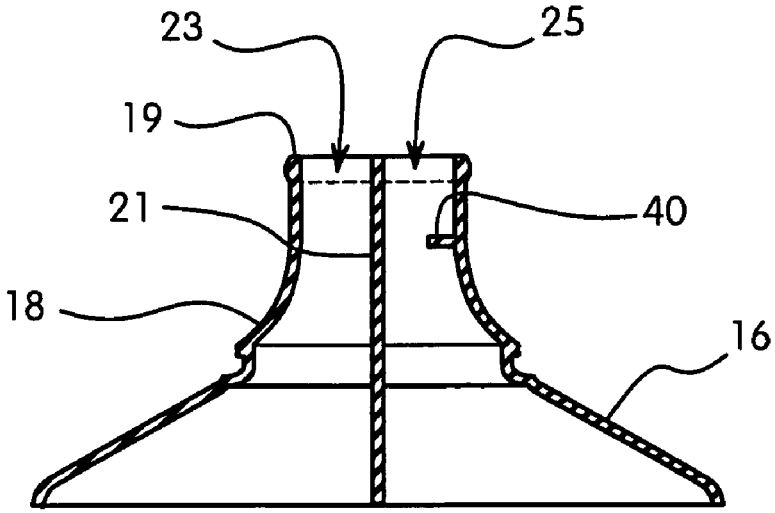
FIG. 4 is a vertical cross-sectional view of a nozzle portion of a dual chamber tube.

FIG. 4 is a cross-sectional view of the nozzle and shoulder portions of FIG. 3. This view along with FIG. 2 better shows the location of the constriction 40 in channel 25. It has been found that to best control flow from a dual chamber tube that the control device should be in the nozzle rather than in the shoulder. The control device should be in the area of greater product shear. At low shear the products in each tube chamber move at about the same rate over a range of rheologies. However, when there is a higher shear one product side can move faster than the other. For a two part dentifrice where one part is a gel and the other a paste with ingredients such as solid polishing agents, the gel will move at a faster rate under higher shear. In this instance the gel part will pass through nozzle channel 25 which has constriction 40 and the flow speed will be reduced. An added benefit is that the constriction 40 also will limit the degree of suckback of the high shear component back down into the tube.

The constrictions 40, 41, 42, 43, 44, 45, 46 and 47(*a*) and 47(*b*) can be placed at various locations in channels 23/25 of nozzle 18. This can be from adjacent the bottom of the nozzle to adjacent the top of the nozzle. A preferred position is one intermediate these locations. In the drawings the constrictions are shown around an intermediate point for illustration purposes. The placement will be at a location of high shear and will be in the channel of the component dispensing at a higher velocity.

Figure 5:
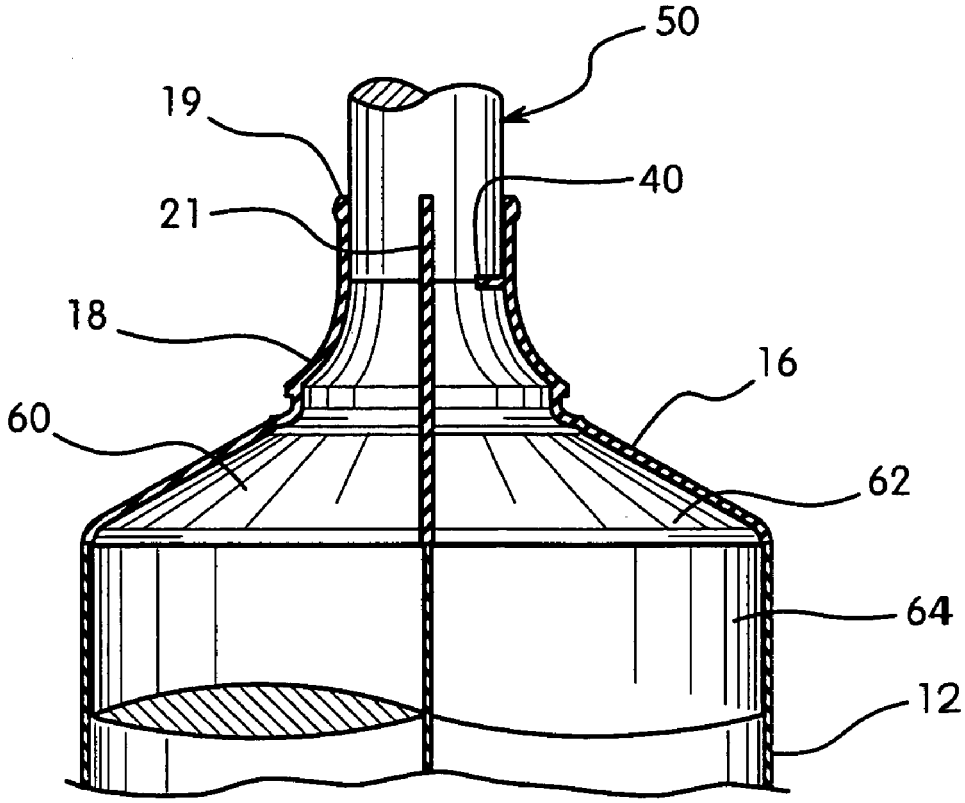
FIG. 5 is an elevation view of the mold to make the nozzle portion of a dual chamber tube partially in section.
Figure 6:
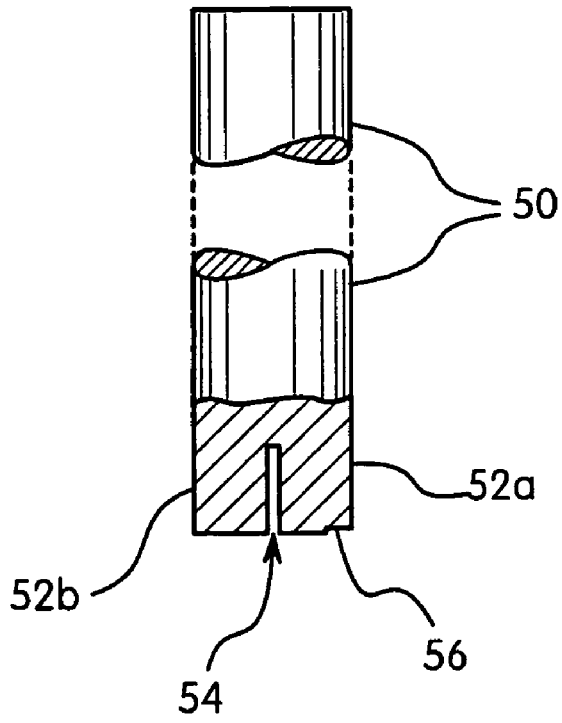
FIG. 6 is an elevation view of the mold pin of FIG. 5.
Figure 7:
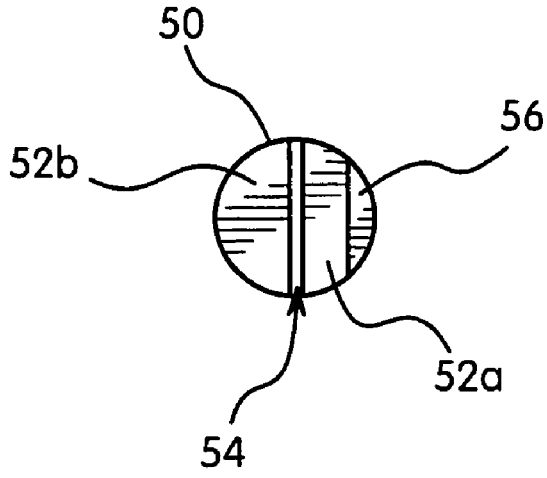
FIG. 7 is a bottom plan view of the mold pin of FIG. 6.

FIG. 5 shows a part of the mold for making the shoulder and nozzle of the tube. There is shown as part of a mold base a first mold section 60, a second mold section 62 and a mold pin 50. Upon compression molding shoulder 16, nozzle 18, and divider wall 21 are formed. FIG. 6 shows the mold pin 50 in more detail. There is gap 54 for forming the divider wall 21 and recess 56 to form the constriction. Mold pin legs 52*a* and 52*b* are on either side of the gap. FIG. 7 is a bottom plan view of the mold pin of FIG. 6.

Figure 8:
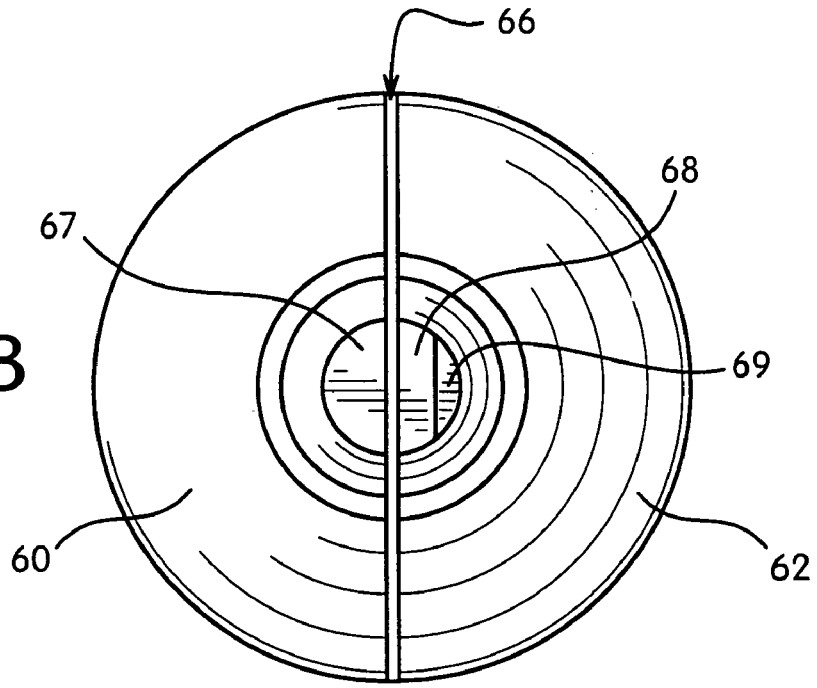
FIG. 8 is a bottom plan view of the upper part of the mold of FIG. 5.
Figure 9:
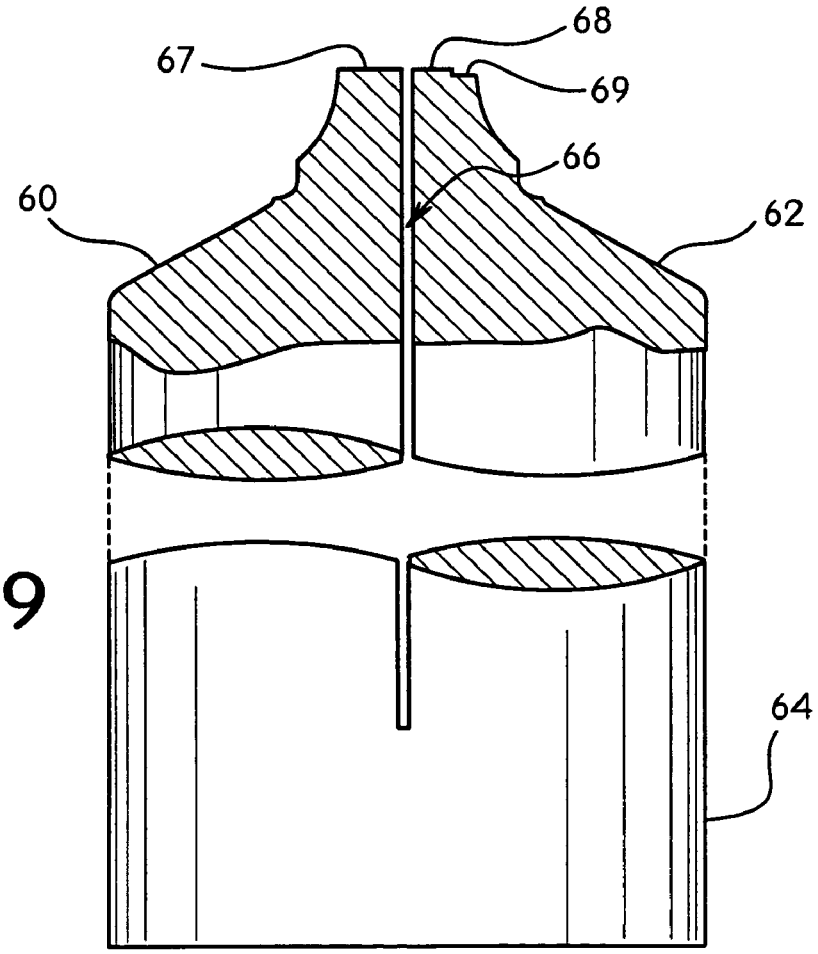
FIG. 9 is an elevation view of the base of the mold of FIG. 5.

FIGS. 8 and 9 are a top plan view and a side elevation view, partially in section, of the mold base mandrel 64 which carries mold upper base sections 60 and 62. There is shown here gap 66 which receives tube body divider wall 17 as the tube body is placed on the mandrel 64. The upper mold base sections 60 and 62 have the shape of the tube shoulder and nozzle. The gap 66 will form the divider wall 21 of the tube shoulder. The top surfaces 67, 68 and 69 will mate with mold pin 50 and an upper mold cavity to complete the mold and form the shoulder and nozzle. The upper mold cavity is comprised of a piece having a complementary shape to that of base mold sections 60 and 62. Mold pin 50 will extend in to the upper mold portion to form part of the channels 23 and 25. In the present embodiment the constriction will be formed by recess 69 of the upper base mold portion 62 and/or by recess 56 of the mold pin 50. Usually only a recess on the mold pin will be needed. However, the option of having a recess in the mold base portion 62 could be useful. Further, if the recess is on the mold pin 50 there need not be a recess on the mold base 64. It is preferred that the recess be on the mold pin since this is a low cost part and can be replaced at a lower cost than a mold base to change the constriction.

The multi-chamber tubes can be comprised of a monolayer material or can be a laminate. Usually the material will be a laminate since laminates offer better protection for the product in the tube. Laminate materials comprise thermoplastics such as ethylene and propylene polymers and copolymers and barrier polymers and copolymers such as ethylene vinyl alcohol and polyamides. The shoulder and nozzle usually will be a thermoplastic that is bondable to material of the tube body. Usually they similarly will be ethylene and propylene polymers and copolymers and barrier polymers and copolymers.

Various products will be packaged in the tubes. The usual products are personal care products and oral care products. Personal care products include hair coloring and treatment products, skin cleansing and related skin care products. Oral care products include dentifrices where the components must be kept separate until use, such as tooth whitening dentifrices which contain a peroxide, baking soda/peroxide dentifrices and high fluoride content dentifrices.

The invention claimed is:

1. A method of controlling the flow of a substance from at least one chamber of a multiple chamber tube container having at least two chambers comprising:

providing a shoulder and a dispensing nozzle at one end and a crimp seal at another end of said tube container, said nozzle having a circular horizontal cross-section and divided into at least two separate channels, said shoulder receiving the substance from the at least one chamber, said dispensing nozzle having an input end having a first cross-sectional area above the shoulder for receiving the substance from the shoulder and an exit dispensing end having a second cross-sectional area, the second cross-sectional area being less than the first cross-sectional area, at least one channel in said dispensing nozzle between the input end and the exit dispensing end in communication with each chamber of the at least two chambers;

providing at least two substances to be dispensed, one of said at least two substances provided in each chamber;

determining the flow rate characteristics for each substance in said at least one channel; and installing a flow modifying unit in the nozzle in a channel of said dispensing nozzle of one substance to reduce the flow of said one substance from the tube container and to limit suck-back of said one substance after a dispensing, wherein the flow modifying unit is at a location in the nozzle intermediate the input end and the exit dispensing end, the location in the nozzle having a cross-sectional area that is equal to the second cross-sectional area.

2. A method as in claim 1 wherein said flow modifying unit is a constriction located at about the intermediate point between the input end and the exit dispensing end of said at least one channel.

3. A method as in claim 2 wherein said at least one channel has an exterior wall and an interior wall separating the at least one channel from another channel, said constriction on at least said exterior wall of said at least one channel.

4. A method as in claim 3 wherein said constriction comprises blocking about 10 percent to about 50 percent of the cross-sectional area of the at least one channel.

5. A method as in claim 1 wherein there are two chambers in said tube container and two channels in said nozzle.

6. A method as in claim 1 wherein said at least one channel has an exterior wall and an interior wall separating the at least one channel from another channel, said constriction on at least said exterior wall of said at least one channel.

7. A method as in claim 6 wherein said constriction comprises blocking about 10 percent to about 50 percent of the cross-sectional area of the at least one channel.

8. A method as in claim 6 wherein there are two chambers in said container and two channels in said nozzle and said flow modifying unit is at about an intermediate point in one of said two channels.

9. A method as in claim 1 wherein there are two channels, at least one of said two channels has an exterior wall and an interior wall separating the at least one channel from another channel, the flow modifying unit being a constriction on at least the interior wall.

10. A method as in claim 1 wherein there are two chambers in said container and two channels in said nozzle and said flow modifying unit is at about an intermediate point in one of said two channels.

11. A method as in claim 9 wherein said substance is a dentifrice.

12. A method as in claim 6 wherein said substance is a dentifrice.

13. A method as in claim 2 wherein said at least one channel has an exterior wall and an interior wall separating the at least one channel from another channel, said constriction on each of said exterior wall and said interior wall of said at least one channel.

14. A method as in claim 13 wherein said constriction extends from said exterior wall to said interior wall.

15. A method as in claim 1 wherein there is a flow modifying unit in each channel.

16. A method of controlling the flow of a substance from at least one chamber of a multiple chamber tube container having at least two chambers comprising:

providing a shoulder and a dispensing nozzle at one end and a crimp seal at another end of said tube container, said nozzle having a circular horizontal cross-section and divided into at least two separate channels, said shoulder receiving the substance from the at least one chamber said dispensing nozzle having an input end having a first cross-sectional area above the shoulder for receiving the substance from the shoulder and an exit dispensing end having a second cross-sectional area, the second cross-sectional area being less than the first cross-sectional area, at least one channel in said dispensing nozzle between the input end and the exit dispensing end in communication with each chamber of the at least two chambers;

providing at least two substances to be dispensed, one of said at least two substances in each chamber;

determining the flow rate characteristics for each substance in said at least one channel; and installing a flow modifying unit in the nozzle at a point in a channel of said dispensing nozzle of one substance to decrease the cross-sectional area of a channel by up to about 60% to thereby reduce the flow of one of said at least two substances from the tube container and to limit suck-back of said one substance after a dispensing; wherein the flow modifying unit is at a location in the nozzle between the input end and the exit dispensing end, the location of the nozzle having a cross-sectional area that is equal to the second cross-sectional area.

17. A method as in claim 16 wherein said flow modifying unit is a constriction located at about the intermediate point between the input end and the exit dispensing end of said at least one channel.

18. A method as in claim 16 wherein said at least one channel has an exterior wall and an interior wall separating the at least one channel from another channel, said constriction on at least said exterior wall of said at least one channel.

19. A method as in claim 17 wherein said at least one channel has an exterior wall and an interior wall separating the at least one channel from another channel, said constriction on each of said exterior wall and said interior wall of said at least one channel.

20. A method as in claim 19 wherein said constriction extends from said exterior wall to said interior wall.

21. A method as in claim 17 wherein there is a flow modifying unit in each channel.

* * * * *